US010060434B2

(12) United States Patent
Deguchi et al.

(10) Patent No.: US 10,060,434 B2
(45) Date of Patent: Aug. 28, 2018

(54) SCROLL COMPRESSOR

(71) Applicant: Valeo Japan Co., Ltd., Saitama (JP)

(72) Inventors: Hironobu Deguchi, Saitama (JP); Kyung-Jae Lee, Saitama (JP)

(73) Assignee: Valeo Japan Co., Ltd., Saitama (JP)

( * ) Notice: Subject to any disclaimer, the term of this patent is extended or adjusted under 35 U.S.C. 154(b) by 0 days.

(21) Appl. No.: 14/892,597

(22) PCT Filed: May 26, 2014

(86) PCT No.: PCT/JP2014/063771
§ 371 (c)(1),
(2) Date: Nov. 20, 2015

(87) PCT Pub. No.: WO2014/192666
PCT Pub. Date: Dec. 4, 2014

(65) Prior Publication Data

US 2016/0108915 A1 Apr. 21, 2016

(30) Foreign Application Priority Data

May 28, 2013 (JP) ..... 2013-111737

(51) Int. Cl.
*F04C 18/02* (2006.01)
*F04C 29/00* (2006.01)

(52) U.S. Cl.
CPC ..... *F04C 18/0284* (2013.01); *F04C 18/0215* (2013.01); *F04C 18/0269* (2013.01); *F04C 18/0292* (2013.01); *F04C 29/005* (2013.01)

(58) Field of Classification Search
CPC ..... F04C 18/0215; F04C 18/0269; F04C 18/0284; F04C 18/0292; F04C 29/005
(Continued)

(56) References Cited

U.S. PATENT DOCUMENTS 4,927,341 A 5/1990 Bush
8,308,460 B2 * 11/2012 Seong ..... F04C 18/0215 418/150
RE46,106 E * 8/2016 Seong ..... F04C 18/0215

FOREIGN PATENT DOCUMENTS

JP 59-142482 U 9/1984
JP H01-163401 A 6/1989
(Continued)

OTHER PUBLICATIONS

Machine Translation JPH 03-264789 Done Jan. 24, 2016.*
International Search Report issued in corresponding application No. PCT/JP2014/063771 dated Aug. 12, 2014 (4 pages).

*Primary Examiner* — Mary A Davis
*Assistant Examiner* — Dapinder Singh
(74) *Attorney, Agent, or Firm* — Osha Liang LLP

(57) ABSTRACT

In a scroll compressor, breakage of a spiral end portion of a spiral wall (10*c*, 11*c*) of a scrolls is prevented.
[Solving means] In a scroll compressor including: a fixed scroll (10) including an end plate (10*a*) and a spiral wall (10*c*) extending upright from the end plate (10*a*); an orbiting scroll (11) including an end plate (11*a*) and a spiral wall (11*c*) extending upright from the end plate (11*a*); and a drive shaft (8) configured to transmit a rotational power to the orbiting scroll (11), and configured to compress a compressed fluid by an orbital motion of the orbiting scroll (11), an extending portion (113) which does not come into contact with the spiral wall (10*c*) of the fixed scroll (10) is provided so as to extend from a spiral end portion (112), which corresponds to a terminal end of a wall surface (compression forming portion (111)) which forms a compression chamber (15) on a spiral wall (11*c*) of the orbiting scroll (11).

9 Claims, 7 Drawing Sheets

(58) Field of Classification Search
USPC ..... 418/55.1–55.6
See application file for complete search history.

(56) References Cited

FOREIGN PATENT DOCUMENTS

| | | | |
|---|---|---|---|
| JP | 3-264789 | A | 11/1991 |
| JP | 11-257259 | A | 9/1999 |
| JP | 2000-249085 | A | 9/2000 |
| JP | 2001-020878 | A | 1/2001 |
| JP | 2001-123971 | A | 5/2001 |
| JP | 2001-173584 | A | 6/2001 |

* cited by examiner

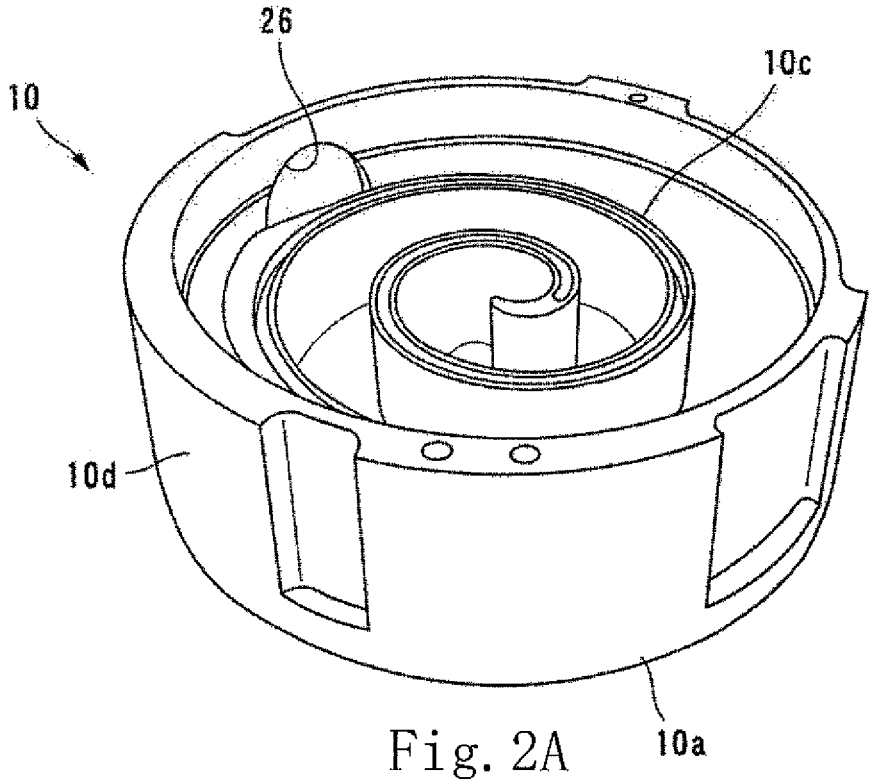
Fig. 2A
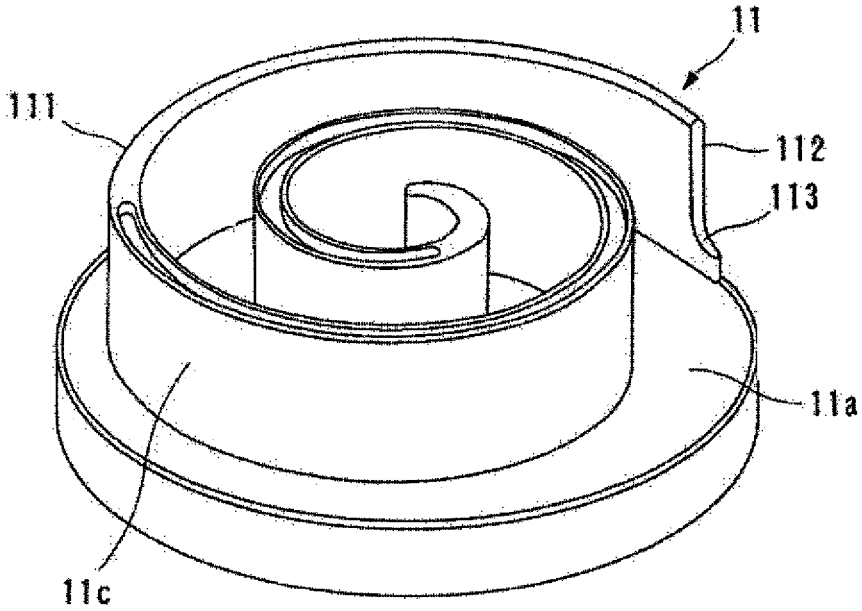
Fig, 2B

SCROLL COMPRESSOR

TECHNICAL FIELD

The present invention relates to a scroll compressor used for a refrigeration cycle or the like of a vehicle air-conditioning apparatus, and specifically, to a scroll compressor in which a spiral wall of a scroll has an improved shape.

BACKGROUND ART

As illustrated in FIG. 9, a scroll compressor includes a fixed scroll 10 having an end plate and a spiral wall 10*c* extending upright from the end plate, an orbiting scroll 11 arranged so as to oppose the fixed scroll 10 and having an end plate and a spiral wall 11*c* extending upright from the end plate, the spiral walls 10*c*, 11*c* of a pair of the scrolls are engaged with each other, and the orbiting scroll 11 is orbited (is caused to make an orbital motion) by a revolving shaft having an eccentric shaft in a state of being restricted from rotating, so that a compression chamber 15 formed between the spiral walls of both of the scrolls is moved toward the center while a volume thereof being reduced to compress a working fluid.

Each of the spiral walls 10*c*, 11*c* is formed so as to draw an involute curve, and the compression chamber 15 includes a first compression chamber partitioned by contact between an outer curved surface of the spiral wall 10*c* of the fixed scroll and an inner curved surface of the spiral wall 11*c* of the orbiting scroll, and a second compression chamber partitioned by contact between an inner curved surface of the spiral wall 10*c* of the fixed scroll and an outer curved surface of the spiral wall 11*c* of the orbiting scroll.

In the scroll compressor of this configuration, as illustrated in FIG. 4 which will be described later, the spiral walls are brought into contact with each other by a centrifugal force or the like in association with orbiting of the orbiting scroll 11, and a force originated by the centrifugal force or the like acts on a contact portion between the spiral walls 10*c*, 11*c* in a direction orthogonal to a contact surface. Since the spiral wall and the end plate are connected integrally with each other, when the orbiting scroll 11 is at an orbital angle position at which portions other than spiral end portions 102, 112 of the spiral walls (which are terminal ends of wall surfaces which form the compression chamber 15 and are end points of contact points which contribute to compression, that is, positions where closing of the compression chamber 15 starts) come into contact with each other, a contact load acting on the contact portion of the spiral walls is transmitted to and supported by end plates 10*a* and 11*a* via connecting portions (connecting portions 10*b*, 11*b*) between the spiral walls 10*c*, 11*c* and the end plates 10*a*, 11*a* extending both sides in the vicinity of the contact portion.

In contrast, when the orbiting scroll 11 is at the orbital angle position at which the spiral end portions 102, 112 of the spiral walls of the scrolls come into contact with the spiral walls of the scrolls of the counterparts, the contact load acting on the contact portion of the spiral walls is transmitted to and supported by the end plate only via the connecting portions with respect to the spiral wall and the end plate extending on one side of the contact portions. Therefore, a shear stress in the vicinity of the contact portion generated at the connecting portion between the spiral walls and the end plates is double the shear stress generated when portions other than the spiral end portions are in contact with each other, so that the spiral walls may be broken unless a sufficient strength is secured on the connecting portions in the vicinities of the spiral end portions.

As the related art relating to an improvement of strength of the spiral end portions of the spiral walls of the scrolls, Patent Literature 1 proposes providing inclined surfaces or stepped surfaces which are gradually reduced in height at spiral end portions of the spiral walls of the scrolls so as to extend therefrom and dispersing stress concentration caused by a centrifugal force. Patent Literature 2 discloses a configuration in which an outer wall and an inner wall of a spiral wall of an orbiting scroll are formed along an involute curve to the spiral end portion, an upper surface of the spiral end portion is set to be relatively lower than other portions to provide a portion which does not contribute to the compression of fluid, and a contact point is provided at this portion so that a pressing force is dispersed owing to the presence of a plurality of the contact points at all the crank angles, whereby likelihood of an occurrence of wear or burning is reduced.

CITATION LIST

Patent Literature

PTL1: JP-A-3-264789
PTL2: JP-A-2009-174407

SUMMARY OF THE INVENTION

Technical Problem

The former configuration is devised to reduce the centrifugal force acting on the spiral end portions by providing the inclined surfaces or the stepped surfaces at the spiral end portions of the spiral walls, and does not reduce the shear stress applied when the spiral end portions of the spiral walls come into contact with the spiral walls of the counterparts. Therefore, when the spiral end portions of the spiral walls are at the orbital angle at which the spiral end portions of the spiral walls come into contact with the spiral walls of the scrolls of the counterparts, the above-described shear stress is generated at the spiral end portions where the inclined surfaces and the stepped surfaces are provided, and hence the same disadvantages as the related art may occur. In the latter configuration as well, even though the end portions which are lowered in height and do not contribute to the compressions are provided on the spiral end portions, since the contact points are provided at the corresponding portions, the shear stress applied to the spiral end portions is not reduced, and the same disadvantages may be caused by the contact load acting on the spiral end portions.

In view of such circumstances, it is a principal object of the present invention to provide a scroll compressor in which prevention of breakage at the spiral end portions of the spiral walls of the scrolls is enabled.

Means for Solving the Problem

In order to achieve the object described above, a scroll compressor of the present invention includes: a fixed scroll including an end plate and a spiral wall extending upright from the end plate; an orbiting scroll arranged so as to oppose the fixed scroll and including an end plate and a spiral wall extending upright from the end plate; and a drive shaft configured to transmit a rotational power to the orbiting scroll, wherein an orbital motion of the orbiting scroll compresses a compressed fluid by moving a compression chamber formed by the fixed scroll and the orbiting scroll toward a center side while reducing a volume thereof, and the spiral wall of at least one of the fixed scroll and the orbiting scroll is provided with an extending portion which does not come into contact with the spiral wall of the counterpart from a spiral end portion being a terminal end of a wall surface that forms the compression chamber.

Therefore, since the spiral wall of at least one of the scrolls is provided with the extending portion which does not come into contact with the spiral wall of the counterpart from the spiral end portion, even when a contact load acts on the spiral end portion so as to press one of the spiral walls outward in a radial direction by contact of the spiral end portion of the one of the spiral walls with the other spiral wall, a shear load can be supported not only by a connecting portion between the spiral end portion extending on one side in the vicinity of a contact portion and the end plate, but also by a connecting portion between the extending portion and the end plate, and hence a reduction of the shear stress is achieved.

Here, the extending portion can be configured to form a non-contact state with respect to the spiral wall of the counterpart by retracting an inner wall surface thereof from the spiral wall of the counterpart opposing thereto. In this configuration, a reduction in thickness of the spiral wall of the counterpart is no longer necessary, and the strength of the spiral wall of the counterpart can be secured.

The extending portion can be configured to form a non-contact state with respect to the spiral wall of the counterpart by retracting an outer wall surface of the spiral wall of the counterpart opposing thereto. In this configuration, a reduction in thickness of the extending portion is no longer necessary, and the strength of the extending portion can be secured.

The extending portion can be configured to have a height from the end plate lower than the height of the spiral wall. Since the extending portion is extended from the spiral end portion, which corresponds to a terminal end of the wall surface for forming the compression chamber, it is not a portion contributing to the compression. Accordingly, by reducing the unnecessary height of the extending portion which does not contribute to the compression, a weight of the scroll can be kept to the minimum necessity while reducing the shear stress by securing a joint area of the spiral end portion with respect to the end plate.

As a mode of setting the height of the extending portion from the end plate to be lower than the height of the spiral wall, a transition part from the spiral end portion to the extending portion can be formed so as to be gradually reduced in height.

In this configuration, by setting the height of the extending portion to be high in the vicinity of the spiral end portion, the spiral wall which tends to tilt outward due to cutting resistance at the time of processing of the spiral wall, is supported and is prevented from being deformed. In contrast, by setting the height to be low at a position far from the spiral end portion, a portion of the spiral end portion which contributes little to the prevention of tilting of the spiral wall due to the cutting resistance can be reduced while securing a contact surface area with respect to the end plate so that an increase in weight of the scroll can be reduced.

A suction port configured to introduce the compressed fluid to the compression chamber is preferably provided on a peripheral wall of the fixed scroll opposing the extending portion.

In this configuration, even in the case where the suction port is provided on the peripheral wall of the fixed scroll opposing the extending portion, since the height of the extending portion is low, an increase in intake resistance of the compressed fluid can be avoided.

Advantageous Effects of Invention

As described thus far, according to the present invention, since the spiral wall of at least one of the fixed scroll and the orbiting scroll is provided with the extending portion which does not come into contact with the spiral wall of the counterpart from the spiral end portion at the terminal end of the wall surface that forms the compression chamber, the connected surface area with respect to the end plate which supports the shear load can be increased at the spiral end portion as well. Therefore, even when the spiral end portion of the spiral wall of the scroll comes into contact with the spiral wall of the scroll of the counterpart and hence the contact load which presses the spiral wall in the radial direction acts on the spiral wall, the shear stress at the connecting portion in the vicinity of the spiral end portion can be reduced, and thus breakage of the spiral wall in the vicinity of the spiral end portion can be prevented.

As a mode of forming the extending portion in a non-contact state, the non-contact state can be formed by retracting the inner wall surface of the extending portion from the spiral wall of the counterpart opposing thereto, or the non-contact state can be formed by retracting the outer wall surface of the spiral wall of the counterpart opposing the extending portion. With the former configuration, the thickness of the spiral wall of the counterpart does not need to be reduced. Consequently, the strength of the spiral wall of the counterpart can be secured. In addition, with the latter configuration, the thickness of the extending portion does not need to be reduced, and thus the strength of the extending portion can be secured easily.

Also, by adopting the configuration in which the height of the extending portion from the end plate is set to be lower than the height of the spiral wall, the weight of the scroll can be kept to the minimum necessity while reducing the shear stress by securing a joint area of the spiral end portion with respect to the end plate.

Particularly, with the configuration in which the height of the transition part from the spiral end portion to the extending portion is gradually reduced, the spiral wall which tends to tilt outward due to the cutting resistance at the time of processing of the spiral wall is supported and prevented from being deformed. In addition, with the configuration in which the height of the portion of the extending portion which contributes little to the prevention of tilting of the spiral wall is reduced, an increase of the weight of the scroll can be restricted.

BRIEF DESCRIPTION OF DRAWINGS

FIG. 2A is a perspective view illustrating a fixed scroll used in the scroll compressor of the present invention, and FIG. 2B is a perspective view illustrating an orbiting scroll used in the scroll compressor according to the present invention.

DETAIL DESCRIPTION OF INVENTION

Hereinafter, an embodiment of a scroll compressor according to the present invention in a case where an electric compressor including a compression mechanism and an electric motor integrated with each other is used will be described with reference to the attached drawings.

Figure 1:
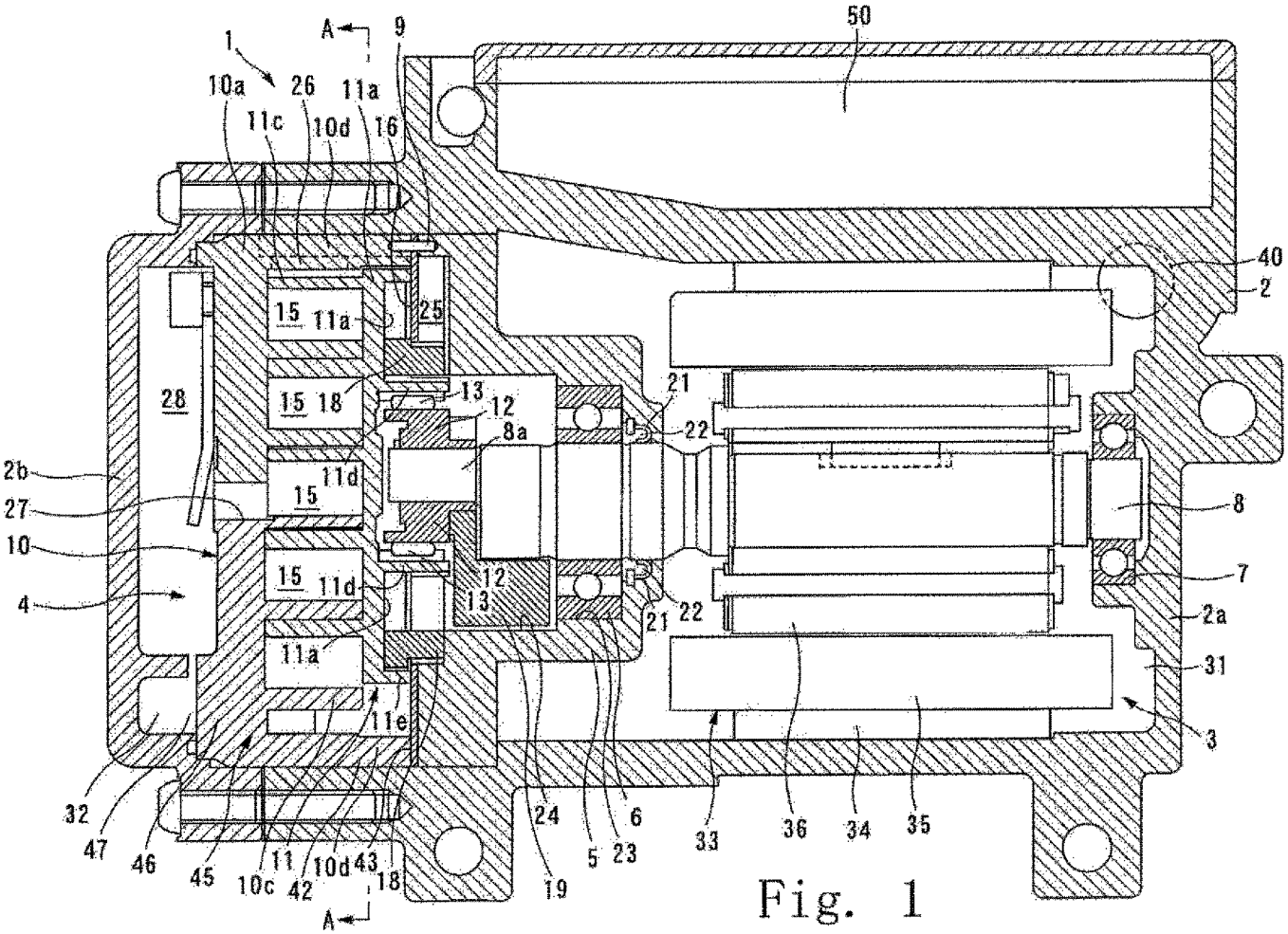
FIG. 1 is a cross-sectional view illustrating an example of an overall configuration of a scroll compressor according to the present invention.

FIG. 1 illustrates an electric compressor 1 suitable for a refrigeration cycle using a refrigerant as a working fluid. The electric compressor 1 is provided with an electric motor 3 in a housing 2 formed of aluminum alloy on the right side in the drawing, and a compression mechanism 4 configured to be driven by the electric motor on the left side in the drawing. In FIG. 1, the right side of the drawing corresponds to the front side of the electric compressor, and the left side of the drawing corresponds to the rear side of the electric compressor.

The housing 2 is provided with a drive shaft 8 rotatably supported by a block member (axially supporting member) 5 fixed to an inside thereof at the midpoint thereof and a front wall portion 2*a* via bearings 6, 7.

A motor accommodating space 31 which accommodates the electric motor 3 is formed in the housing 2 on the front side of the block member 5, and a stator 33, which constitutes part of the electric motor 3, is accommodated therein. The stator 33 includes an iron core 34 having a cylindrical shape and a coil 35 wound therearound, and is fixed to an inner surface of the housing 2. A rotor 36 composed of magnets and rotatably accommodated inside the stator 33 is fixedly mounted on the drive shaft 8, and the rotor 36 is configured to be rotated by a rotational magnetic force formed by the stator 33.

Figure 3A:
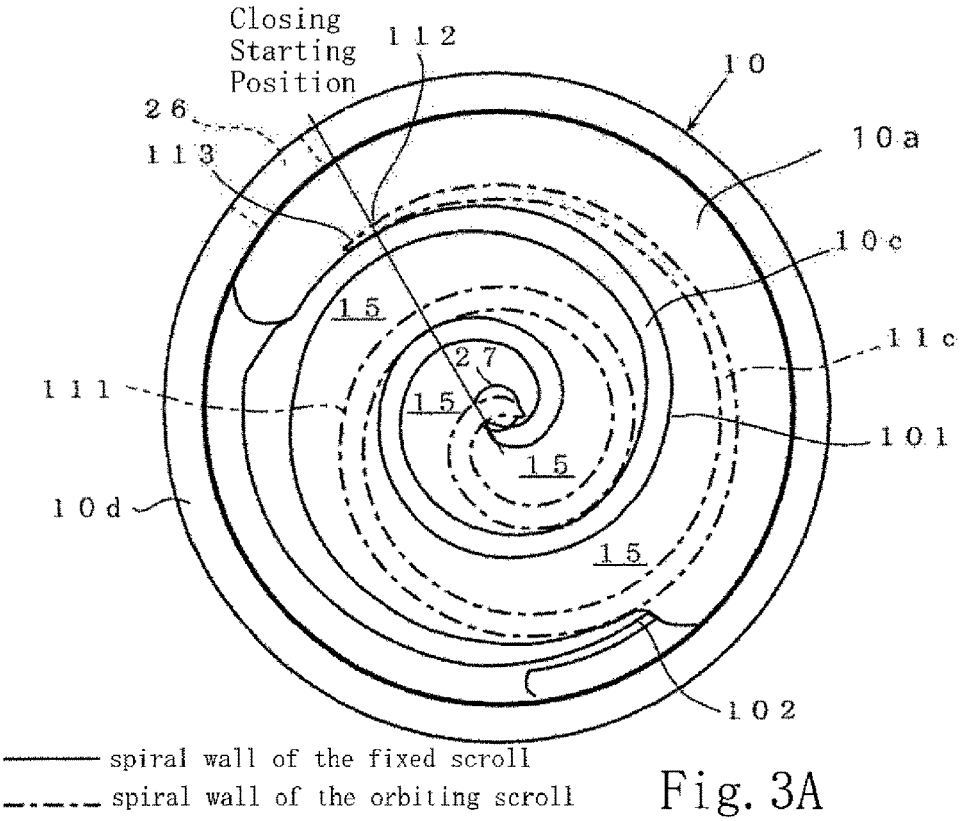
FIG. 3A is a drawing of the fixed scroll used in the scroll compressor according to the present invention viewing from a spiral wall side (a spiral wall of the orbiting scroll is illustrated in an imaginary line)

The compression mechanism 4 is a scroll type including a fixed scroll 10 and an orbiting scroll 11 arranged so as to oppose the fixed scroll 10. As also illustrated in FIG. 2 A, FIG. 3A, and FIG. 4, the fixed scroll 10 includes a disc-shaped end plate 10*a* fixed to a rear portion inside the housing 2, a cylindrical outer peripheral wall 10*d* provided over an entire circumference along an outer edge of the end plate 10*a* and so as to extend toward the front, and a spiral-shaped spiral wall 10*c* provided so as to extend from the end plate 10*a* toward the front via a connecting portion 10*b* inside the outer peripheral wall 10*d*.

Figure 3B:
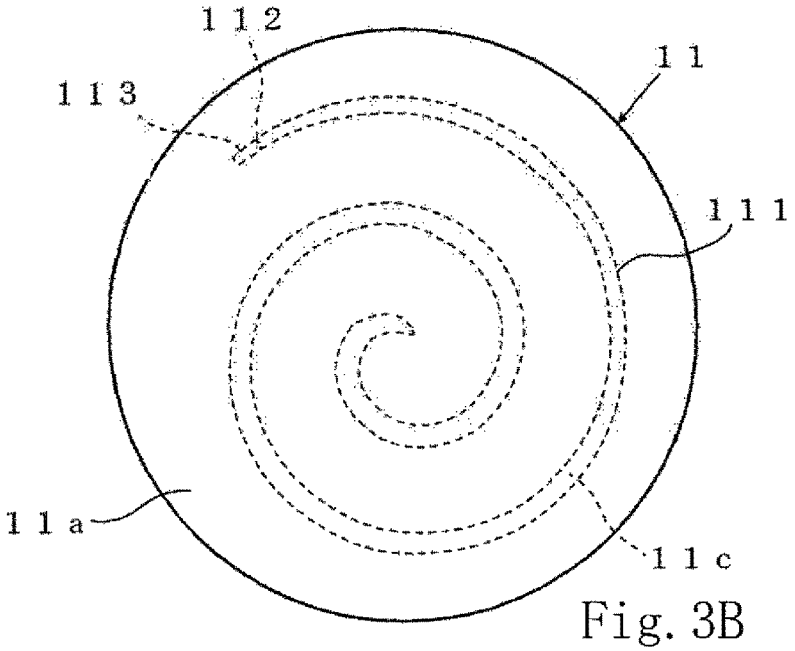
FIG. 3B is a drawing of the orbiting scroll used M the scroll compressor according to the present invention when viewing from an end plate side (the spiral wall of the orbiting scroll is illustrated by a broken line).
Figure 4:
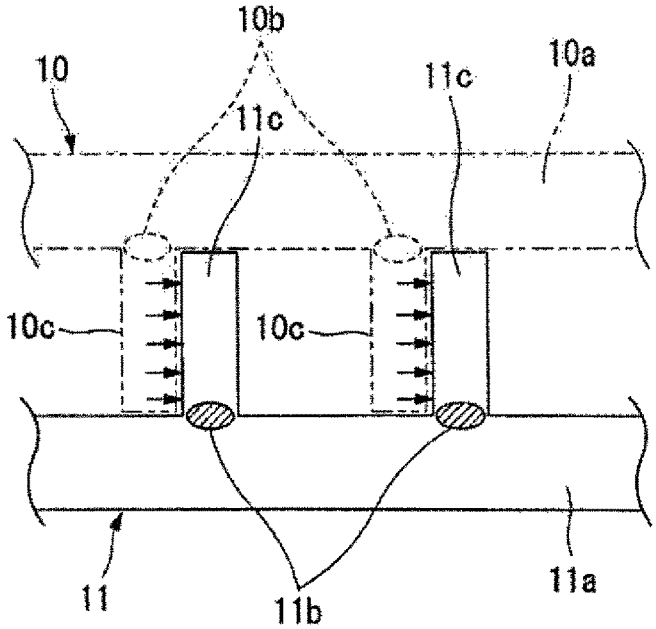
FIG. 4 is an explanatory drawing illustrating a relationship between the fixed scroll and the orbiting scroll.

As also illustrated in FIG. 2B, FIG. 3B, and FIG. 4, the orbiting scroll 11 includes a disc-shaped end plate 11*a* and a spiral-shaped spiral wall 11*c* extending rearward from the endplate 11*a* via a connecting portion 11*b*, and an eccentric shaft 8*a* provided at a rear end portion of the drive shaft 8 eccentrically with respect to an axial center of the drive shaft 8 is coupled to a boss portion 11*d* formed on a rear surface of the end plate 11*a* via a bush 12 and a bearing 13 and is supported so as to allow an orbital motion about an axial center of the drive shaft 8.

The fixed scroll 10 and the orbiting scroll 11 engage with each other by the spiral walls 10*c*, 11*c* thereof, and distal ends of the spiral walls 10*c*, 11*c* in the extending directions oppose each other with a minute clearance with respect to inner surfaces of the end plates 10*a* and 11*a*. Therefore, a compression chamber 15 is defined in a space surrounded by the end plate 10*a* and the spiral wall 10*c* of the fixed scroll 10 and the end plate lie and the spiral wall 11*c* of the orbiting scroll 11.

A thin-plate-shaped annular thrust race 16 is held between the outer peripheral wall 10*d* of the fixed scroll 10 and the block member 5, and the fixed scroll 10 and the block member 5 abut against each other via the thrust race 16.

The thrust race 16 is formed of a material superior in wear resistance, is formed into a size having an outer edge shape which matches the outer edge shape of an end surface of the block member 5, and includes a hole at a center thereof to allow an insertion of the boss portion 11*d* of the orbiting scroll 11 therethrough. The fixed scroll 10, the thrust race 16, and the block member 5 are positioned and fixed by a positioning pin 9.

The block member 5 is formed into a cylindrical shape having an inner surface with a diameter increasing step-by-step as it goes toward the compression mechanism 4 and includes, from the front side farthest from the thrust race 16, a seal accommodating portion 22 configured to accommodate a seal member 21 configured to seal between the block member 5 and the drive shaft 8, a bearing accommodating portion 23 configured to accommodate the bearing 6, a weight accommodating portion 24 configured to accommodate a balance weight 19 which rotates in association with a rotation of the drive shaft 8 integrally with the bush 12, and an Oldham accommodating portion 25 configured to accommodate an Oldham's ring 18 as a rotation preventing mechanism disposed between the end surface of the block member 5 and the end plate 11*a* of the orbiting scroll 11.

Therefore, the orbiting scroll 11 is configured to make an orbital motion with respect to the axial center of the drive shaft 8 while being restricted from a rotation by the Oldham's ring 18 against a rotating force generated in association with the rotation of the drive shaft 8.

The outer peripheral wall 10*d* of the fixed scroll 10 described above is provided with an suction port 26 configured to intake a refrigerant introduced through an inlet port 40, which will be described later, via the motor accommodating space 31, and a discharge chamber 28 to which refrigerant gas compressed by the compression chamber 15 is discharged via a discharge hole 27 formed at a substantially center of the fixed scroll 10 is defined in the housing on the rear side of the fixed scroll 10 by a rear wall 2*b* of the housing 2. The refrigerant gas discharged into the discharge chamber 28 has oil separated here to some extent, and the separated oil is pumped to an external refrigerant circuit from a discharge port, which is not illustrated. The separated oil and the refrigerant containing oil are also accumulated in an accumulating chamber 32 provided under the discharge chamber 28.

The inlet port 40 configured to intake refrigerant gas is formed on a side surface of the housing 2, which faces the motor accommodating space 31, and the refrigerant flowed from the inlet port 40 into the motor accommodating space 31 is introduced to the suction port 26 via a gap between the stator 33 and the housing 2, a passage between the block member 5 and the housing 2, which is not illustrated, and a gap formed between the fixed scroll 10 and the housing 2.

Reference numeral 50 denotes an inverter accommodating chamber configured to accommodate an inverter drive circuit not illustrated, which is formed on an upper portion of the housing 2 and configured to control power distribution of the electric motor 3, in which the inverter drive circuit and the stator 33 are electrically connected via a relay terminal, which is not illustrated, to supply power from the inverter drive circuit to the electric motor 3.

Therefore, when the electric motor 3 rotates and thus the drive shaft 8 rotates, the orbiting scroll 11 rotates about the eccentric shaft 8*a* in the compression mechanism 4. Therefore, the orbiting scroll 11 orbits around the axial center of the fixed scroll 10. At this time, the orbiting scroll 11 is prevented from rotating by a rotation preventing mechanism composed of the Oldham's ring 18, and thus only the orbital motion is allowed.

With the orbital motion of the orbiting scroll 11, the compression chamber 15 moves from an outer peripheral side of the spiral walls 10*c*, 11*c* of both of the scrolls toward the center while gradually reducing the volume thereof. Therefore, the refrigerant gas taken from the suction port 26 into the compression chamber 15 is compressed, the compressed refrigerant gas is discharged into the discharge chamber 28 via the discharge hole 27 formed in the end plate 10*a* of the fixed scroll 10, and then is delivered to the external refrigerant circuit via a discharge port, which is not illustrated.

Figure 5:
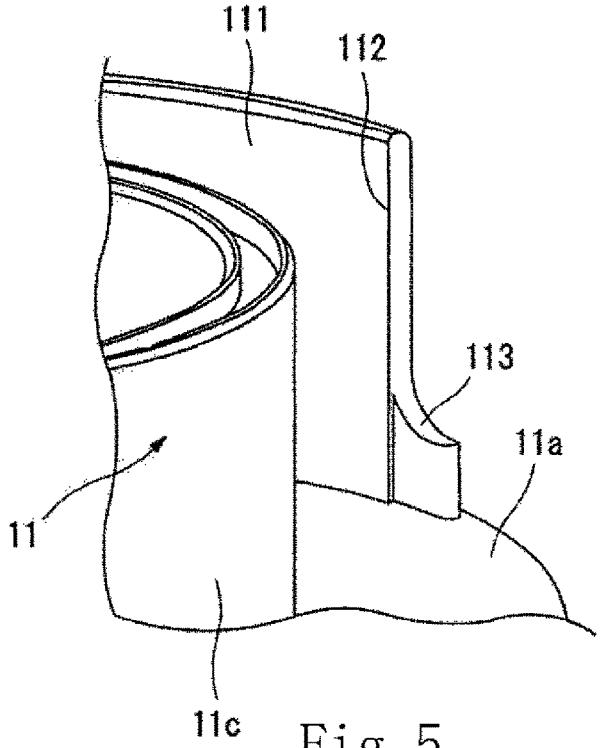
FIG. 5 is a perspective view illustrating a portion in the vicinity of a spiral end portion of the orbiting scroll.

In the electric compressor 1 having configuration as described above, the spiral wall 10*c* of the fixed scroll 10 and the spiral wall 11*c* of the orbiting scroll 11 include compression forming portions 101, 111 for forming the compression chamber 15 and spiral end portions 102, 112 which correspond to the terminal ends of the wall surfaces for forming the compression chamber 15. The spiral wall 11*c* of the orbiting scroll 11 is further provided with an extending portion 113 extending from the spiral end portion 112 as illustrated in FIG. 5.

The compression forming portions 101, 111 of the spiral walls 10*c*, 11*c* of the respective scrolls are formed to have a curved surface along an involute curve from starting points of spirals located at a center portion of the scrolls to the spiral end portions 102, 112, respectively. The spiral end portions 102, 112 are portions which come into contact with the spiral walls of the counterpart at the outermost side of the spiral walls 10*c*, 11*c* (end points of the contact points which contribute to the compression), and are positions where the closing of the compression chamber 15 starts.

Figure 6:
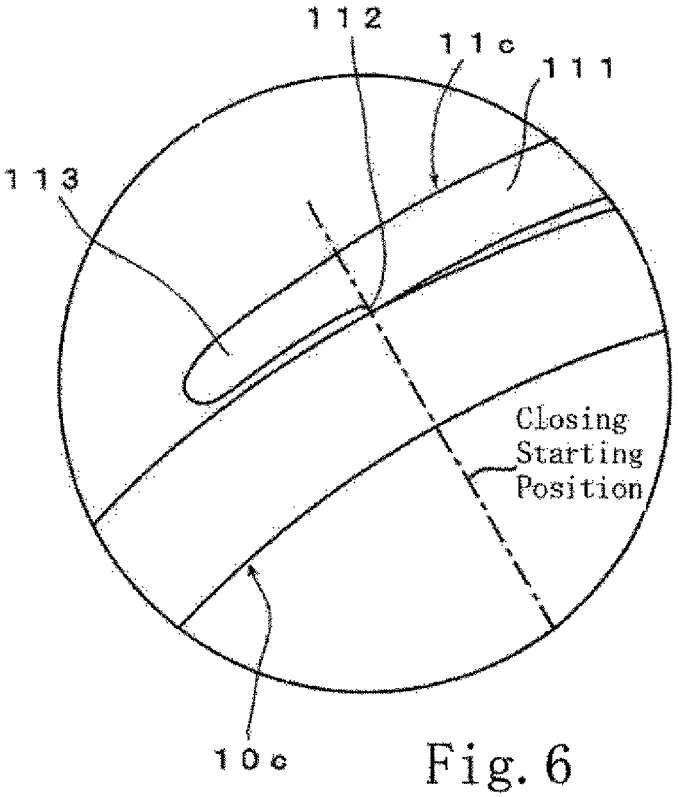
FIG. 6 is a drawing illustrating an example of a configuration in which an inner wall surface of an extending portion provided on the orbiting scroll is retracted from a spiral wall of the fixed scroll opposing thereto.

The extending portion 113 formed on the orbiting scroll 11 extends so as to avoid contact with the spiral wall 10*c* of the fixed scroll 10 and can be, and can not be formed along the involute curve. In this example, as illustrated in FIG. 6, the extending portion 113 and the spiral wall 10*c* of the fixed scroll 10 are kept out of contact by retracting the inner wall surface of the extending portion 113 from the spiral wall 10*c* of the fixed scroll 10 opposing thereto.

The extending portion 113 is set to have a height from the endplate 11*a* lower than the height of the spiral wall 11*c*. In this example, a height of a transition part from the spiral end portion 112 to the extending portion 113 from the end plate is set to gradually reduce.

The extending portion 113 is provided on a portion opposing the suction port 26 provided on a peripheral wall of the fixed scroll 10, and the compressed fluid introduced via the suction port 26 flows along the periphery of the extending portion 113 and introduced into the compression chamber 15.

Figure 7:
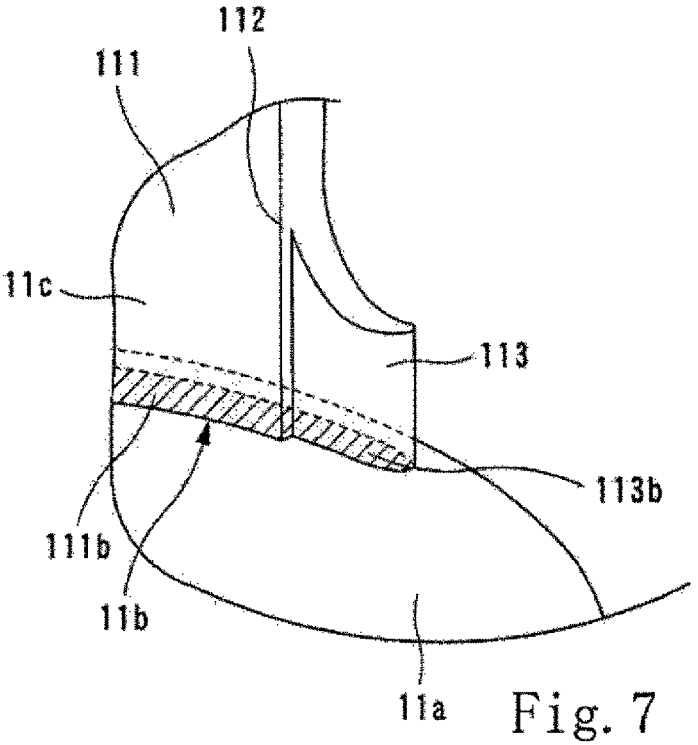
FIG. 7 is an enlarged perspective view illustrating a connecting portion of an end plate with the spiral wall and the extending portion in the vicinity of the spiral end portion of the orbiting scroll.

In the configuration described above, when the orbiting scroll 11 orbits around the axial center of the fixed scroll 10 and the spiral end portion 112 comes into contact with the spiral wall 10*c* of the fixed scroll 10, the compressed fluid is trapped in the compression chamber 15, and the compression of the trapped compressed fluid starts. However, even though the spiral end portion 112 comes into contact with the spiral wall 10*c* of the fixed scroll 10 and a contact load acts on radially outside of the spiral end portion 112, the spiral wall 11*c* of the orbiting scroll 11 is provided with the extending portion 113, which does not come into contact with the spiral wall 10*c* of the fixed scroll 10, from the spiral end portion 112, and thus receives the contact load acting so as to shear the spiral wall 11*c* from the end plate 11*a* not only by a connecting portion 111*b* connecting the spiral wall 11*c* extending in the compression forming portion 111 to the end plate 11*a*, but also by a connecting portion 113*b* connecting the extending portion 113 to the end plate 11*a* as illustrated in FIG. 7. Therefore, a surface area which supports the shear load is sufficiently secured in the vicinity of the spiral end portion 112, and the shear stress in the vicinity of the spiral end portion 112 can be reduced, so that the breakage of the spiral wall of the spiral end portion 112 is prevented.

In the configuration described above, since a non-contact state with respect to the spiral wall 10*c* of the fixed scroll 10 is achieved by retracting the inner wall surface of the extending portion 113 from the spiral wall 10*c* of the fixed scroll 10 facing thereto, a reduction in thickness of the spiral wall 10*c* of the fixed scroll 10 is no longer necessary and the strength of the spiral wall 10*c* of the fixed scroll 10 can be secured.

In addition, since the extending portion 113 is formed so that the height of the transition part from the spiral end portion 112 from the end plate 11*a* is gradually reduced, the spiral wall 11*c* which tends to tilt outward by a cutting resistance at the time of processing is supported and is prevented from being deformed, and in addition, an increase in weight of the orbiting scroll 11 can be restrained while securing the contact surface area with respect to the endplate 11*a*.

In the case of processing the spiral wall of the scroll with an end mill, when a portion to be processed of the spiral wall is processed by the tool, the portion to be processed is pressed against the tool due to the cutting resistance, and hence is perpendicular to the end plate so as to extend along the tool. However, after the tool has passed, such a phenomenon that the spiral wall is inclined inward due to elasticity of the spiral wall itself which is released from the cutting resistance (so-called spring back) occurs. Such a phenomenon is negligible because both sides of the portion to be processed are supported by a spiral wall 111 while processing portions other than the spiral end portion. However, in processing of the spiral end portion 112 of the spiral wall having the structure of the related art, the spiral wall is deformed radially outward due to the cutting resistance generated at the time of processing because the spiral wall

111 exists only on one side of the spiral end portion, and after the processing, tends to incline inward due to elasticity of the spiral wall itself, and thus there is a concern that a problem of breakage of the spiral end portion may occur when the spiral walls come into contact with each other at that portion.

Accordingly, by gradually reducing the height of the extending portion from the end plate, the height of the extending portion is secured at a portion in the vicinity of the spiral end portion to support the spiral wall which tends to tilt outward due to the cutting resistance at the time of processing and prevent deformation thereof. In contrast, at a portion far from the spiral end portion, since the degree of contribution to the effect of preventing the inclination caused by the cutting resistance of the spiral end portion is low, the height of the extending portion which does not need to be high is set to be low, so that an increase in weight of the scroll can be avoided.

In addition, since the height of the extending portion from the end plate is gradually reduced from the spiral end portion, even when the suction port 26 configured to introduce the compressed fluid to the compression chamber 15 is provided on the outer peripheral wall 10*d* of the fixed scroll 10 facing the extending portion 113, an increase in intake resistance of the compressed fluid can be avoided and thus the provision of the extending portion 113 does not cause any problem.

Figure 8:
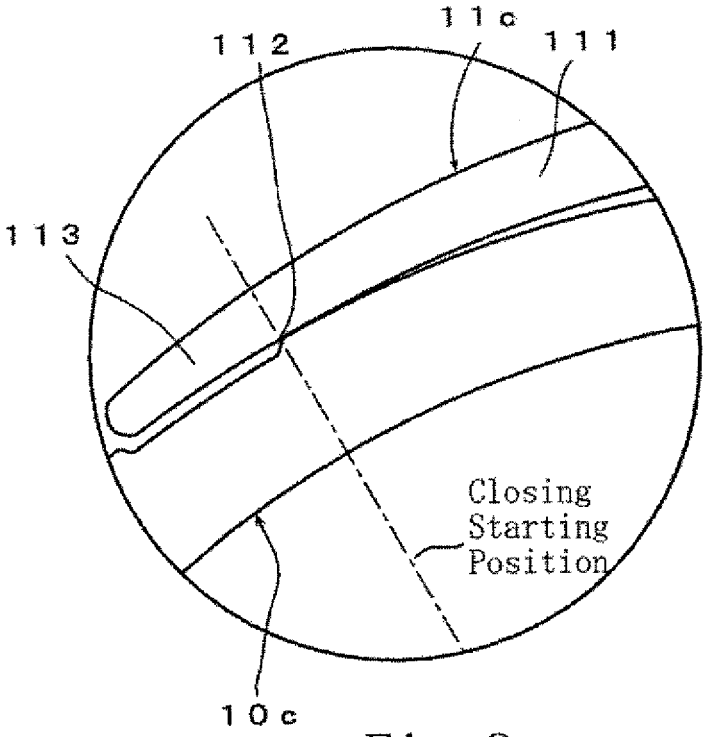
FIG. 8 is a drawing illustrating an example of a configuration in which an outer wall surface of the spiral wall of the fixed scroll opposing the extending portion provided on the orbiting scroll is retracted.
Figure 9A:
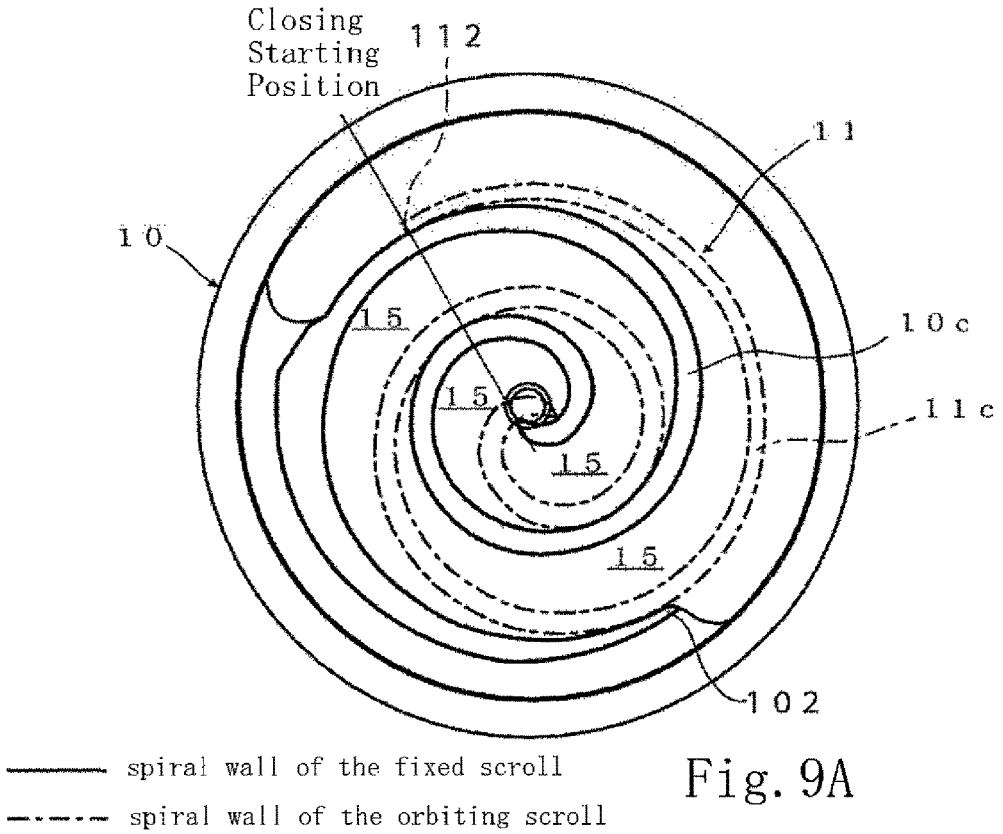
FIG. 9A is a drawing illustrating a state in which a fixed scroll and an orbiting scroll of the related art are combined (a spiral wall of the orbiting scroll is illustrated by an imaginary line)
Figure 9B:
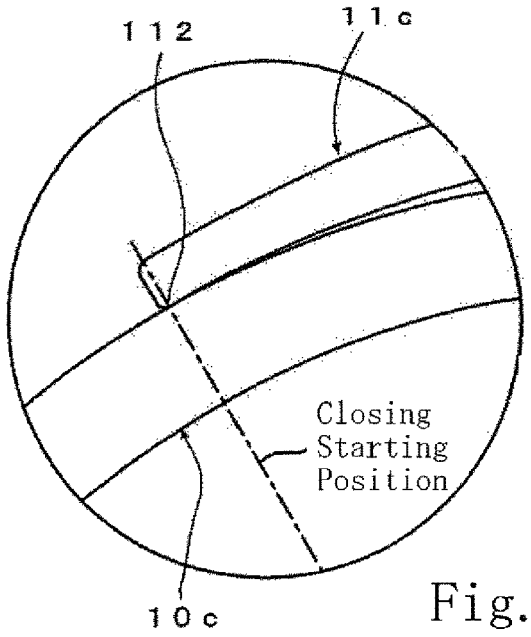
FIG. 9B is an enlarged plan view illustrating a portion in the vicinity of a spiral end portion of the orbiting scroll.

Although an example of forming the non-contact state by retracting the inner wall surface of the extending portion 113 from the spiral wall 10*c* of the fixed scroll 10 opposing thereto has been described in the configuration described above, the non-contact state can be achieved by retracting the outer wall surface of the spiral wall 10*c* of the fixed scroll 10 opposing the extending portion 113 as illustrated in FIG. 8.

In this configuration, a reduction in thickness of the extending portion 113 is no longer necessary, and the strength of the extending portion 113 can be secured.

In the configuration described above, an example of configuration in which the extending portion 113 is formed from the spiral end portion 112 on the spiral wall 11*c* of the orbiting scroll 11 has been described. Instead of, or in addition to this configuration, however, an extending portion can be formed on the spiral end portion 102 of the spiral wall 10*c* of the fixed scroll 10.

In addition, although an example in which the configuration described above is adopted to the scroll electric compressor has been described, the same configuration can also be adopted in the scroll compressor in which a drive force is transmitted from the outside.

REFERENCE SIGNS LIST

1 electric compressor
8 drive shaft
10 fixed scroll
10*a* end plate
10*c* spiral wall
11 orbiting scroll
11*a* end plate
11*c* spiral wall
15 compression chamber
26 suction port
101, 111 compression forming portion
102, 112 spiral end portion
113 extending portion

The invention claimed is:

1. A scroll compressor comprising:

a fixed scroll including an end plate and a first spiral wall extending upright from the end plate;

an orbiting scroll arranged so as to oppose the fixed scroll and including an end plate and a second spiral wall extending upright from the end plate; and a drive shaft configured to transmit a rotational power to the orbiting scroll, the orbiting scroll making an orbital motion and compressing a compressed fluid by moving a compression chamber formed by the fixed scroll and the orbiting scroll toward a center side while reducing a volume thereof, wherein the second spiral wall is provided with an extending portion which does not come into contact with the first spiral wall, the extending portion being from a spiral end portion at a terminal end of a wall surface that forms the compression chamber, and wherein a height of the extending portion from the end plate is gradually reduced and terminates in a face with a height greater than zero.

2. The scroll compressor according to claim 1, wherein the extending portion forms a non-contact state with respect to the first spiral wall by retracting an inner wall surface thereof from the first spiral wall opposing thereto.

3. The scroll compressor according to claim 2, wherein the height of the extending portion from the end plate is set to be lower than a height of the spiral wall.

4. The scroll compressor according to claim 3, wherein a height of a transition part from the spiral end portion to the extending portion is gradually reduced.

5. The scroll compressor according to claim 4, wherein a suction port configured to introduce the compressed fluid to the compression chamber is provided on a peripheral wall of the fixed scroll facing the extending portion.

6. The scroll compressor according to claim 3, wherein a suction port configured to introduce the compressed fluid to the compression chamber is provided on a peripheral wall of the fixed scroll facing the extending portion.

7. The scroll compressor according to claim 1, wherein a height of a transition part from the spiral end portion to the extending portion is gradually reduced.

8. The scroll compressor according to claim 7, wherein a suction port configured to introduce the compressed fluid to the compression chamber is provided on a peripheral wall of the fixed scroll facing the extending portion.

9. The scroll compressor according to claim 1, wherein a suction port configured to introduce the compressed fluid to the compression chamber is provided on a peripheral wall of the fixed scroll facing the extending portion.

* * * * *